US007168984B2

(12) United States Patent
Perle et al.

(10) Patent No.: US 7,168,984 B2
(45) Date of Patent: Jan. 30, 2007

(54) ELECTRICAL CONNECTOR

(75) Inventors: Marcel Perle, Feldkirch (AT); Martin Kopf, Koblach (AT)

(73) Assignee: Hirschmann Automotive GmbH, Rankweil/Brederis (AT)

( * ) Notice: Subject to any disclaimer, the term of this patent is extended or adjusted under 35 U.S.C. 154(b) by 0 days.

(21) Appl. No.: 11/367,027

(22) Filed: Mar. 2, 2006

(65) Prior Publication Data

US 2006/0205276 A1 Sep. 14, 2006

(30) Foreign Application Priority Data

Mar. 2, 2005 (DE) ..... 10 2005 009 442

(51) Int. Cl.
*H01R 13/58* (2006.01)

(52) U.S. Cl. ..... 439/606

(58) Field of Classification Search ..... 439/604, 439/606

See application file for complete search history.

(56) References Cited

U.S. PATENT DOCUMENTS

| | | | | |
|---|---|---|---|---|
| 4,602,831 | A * | 7/1986 | Lockard | 439/108 |
| 4,615,578 | A * | 10/1986 | Stadler et al. | 439/607 |
| 4,690,647 | A * | 9/1987 | Hamsher et al. | 439/92 |
| 4,737,117 | A * | 4/1988 | Lockard | 439/92 |
| 5,100,347 | A * | 3/1992 | Malasky et al. | 439/604 |
| 5,364,292 | A * | 11/1994 | Bethurum | 439/610 |
| 5,580,264 | A * | 12/1996 | Aoyama et al. | 439/275 |
| 6,203,376 | B1 * | 3/2001 | Magajne et al. | 439/610 |
| 6,217,372 | B1 * | 4/2001 | Reed | 439/497 |
| 6,394,839 | B2 * | 5/2002 | Reed | 439/497 |
| 6,428,344 | B1 * | 8/2002 | Reed | 439/455 |
| 6,485,333 | B1 * | 11/2002 | Shinchi | 439/587 |
| 6,722,898 | B2 * | 4/2004 | Peloza et al. | 439/108 |
| 6,726,503 | B2 * | 4/2004 | Waddell et al. | 439/465 |
| 6,790,087 | B2 * | 9/2004 | Ho | 439/606 |
| 6,823,587 | B2 * | 11/2004 | Reed | 29/858 |
| 6,893,295 | B1 * | 5/2005 | Lloyd et al. | 439/610 |
| 6,926,562 | B1 * | 8/2005 | Wu | 439/660 |
| 6,932,640 | B1 * | 8/2005 | Sung | 439/405 |
| 6,955,565 | B2 * | 10/2005 | Lloyd et al. | 439/607 |
| 6,971,923 | B1 * | 12/2005 | Wu | 439/694 |
| 6,974,353 | B2 * | 12/2005 | Liu et al. | 439/680 |
| 6,976,869 | B1 * | 12/2005 | Wu | 439/499 |
| 6,984,150 | B2 * | 1/2006 | Kondou et al. | 439/606 |
| 7,086,888 | B2 * | 8/2006 | Wu | 439/358 |
| 2003/0129875 | A1 * | 7/2003 | Ho | 439/606 |

(Continued)

FOREIGN PATENT DOCUMENTS

| | | |
|---|---|---|
| EP | 1 122 840 | 8/2001 |

(Continued)

*Primary Examiner*—Ross Gushi
(74) *Attorney, Agent, or Firm*—Andrew Wilford

(57) ABSTRACT

An electrical connector has a hard base part forming a plurality of rearwardly and forwardly open seat, respective contacts in the seats each having a front end and a rear end, and respective wires projecting forwardly into the seats and connected in the seats to the rear contact ends. A guide spaced rearward from the base part is engaged at least partially around the wires and aligns the wires with the respective seats. A connector element carries the guide on the base part. A soft jacket encapsulates a rear end of the base part, the guide, the element, and front ends of the wires and extends at least partially into the rear seat ends.

8 Claims, 3 Drawing Sheets

U.S. PATENT DOCUMENTS

| | | | | |
|---|---|---|---|---|
| 2003/0176085 | A1* | 9/2003 | Laker | 439/76.1 |
| 2004/0097132 | A1* | 5/2004 | Cheng | 439/606 |
| 2004/0097133 | A1* | 5/2004 | Liu | 439/606 |
| 2004/0229510 | A1* | 11/2004 | Lloyd et al. | 439/610 |
| 2005/0014417 | A1* | 1/2005 | Karino et al. | 439/606 |
| 2005/0124227 | A1* | 6/2005 | Liu et al. | 439/680 |
| 2005/0159047 | A1* | 7/2005 | Takahashi | 439/610 |
| 2005/0272303 | A1* | 12/2005 | Wu | 439/499 |
| 2006/0030215 | A1* | 2/2006 | Wu | 439/610 |
| 2006/0035531 | A1* | 2/2006 | Ngo | 439/701 |
| 2006/0094282 | A1* | 5/2006 | Biermann et al. | 439/375 |
| 2006/0141867 | A1* | 6/2006 | Lui et al. | 439/660 |
| 2006/0154516 | A1* | 7/2006 | Padula | 439/521 |

FOREIGN PATENT DOCUMENTS

| | | |
|---|---|---|
| EP | 1 143 580 | 10/2001 |

* cited by examiner

ELECTRICAL CONNECTOR

FIELD OF THE INVENTION

The present invention relates to an electrical connector.

BACKGROUND OF THE INVENTION

In EP 1,122,840 of Jager and EP 1,143,580 of Jure an electrical connector is described that comprises a prefabricated dielectric base part forming two spaced rows of seats each adapted to hold a contact secured by soldering or crimping to the conductor of a respective insulated wire projecting rearwardly out of the part. The contacts can be male or female and can project forward from or be exposed forward so that the connector can be a plug or socket.

In addition this connector has as also described in U.S. Pat. No. 5,580,264 of Aoyama an integral one-piece jacket or shroud that is molded in place over the rear end of the base part and the front ends of the wires where they enter the base part. Thus this jacket serves as a strain relief and also as a rear-end seal preventing any entry of moisture into the connector along the wires from the rear. Such a connector is employed extensively in motor vehicles where it is subjected to harsh environmental conditions, vibration, dirt and, above all, moisture so that it must be rugged and very well sealed.

To further protect the connector, the base part is formed with one or more laterally open slots that are aligned with the rear crimp or solder end of the contact so that when the jacket is molded over the base part, its elastomeric material flows into the base part and encapsulates the rear end of the contact. To prevent this material from flowing forward during the injection-molding process into the contact seats and getting on the front ends of the contacts, where their metal must be exposed so that they can do their job, the mold is provided with projections that engage into the lateral slots and prevent such forward flow of the elastomer. Furthermore the mold has a part that fits between the two rows of contacts to close this gap and prevent forward flow here too.

This molding of the rear seal and strain-relief element is therefore a fairly complex process and the mold for making it has several parts. As a result, production costs for the connector, which is a mass-production item made in very high volume, are unacceptably high.

OBJECTS OF THE INVENTION

It is therefore an object of the present invention to provide an improved electrical connector.

Another object is the provision of such an improved electrical connector that overcomes the above-given disadvantages, in particular that is of simpler and easier-to-manufacture construction.

SUMMARY OF THE INVENTION

An electrical connector has according to the invention a hard base part forming a plurality of rearwardly and forwardly open seat, respective contacts in the seats each having a front end and a rear end, and respective wires projecting forwardly into the seats and connected in the seats to the rear contact ends. A guide spaced rearward from the base part is engaged at least partially around the wires and aligns the wires with the respective seats. A connector element carries the guide on the base part. A soft jacket encapsulates a rear end of the base part, the guide, the element, and front ends of the wires and extends at least partially into the rear seat ends.

With this system, therefore, the wires are aligned so they are oriented precisely immediately adjacent the base part. This not only prevents overheating and damage to the wires, but ensures that they are perfectly positioned when the base part is clamped in the mold used to form the jacket around it. In addition with multiple wires the guide holds them apart so that the material of the jacket is certain to get in between them and adhere to them, effectively closing off any possibility of leakage between the wires.

According to the invention the element is flexible. This makes it easy to fit it to the incoming wires and orient them. The guide, element, and part can be unitary so that they constitute one piece that is easy to handle and cheap to manufacture.

The transverse passage extends across the seats generally at the rear seat ends. A flow-blocking bar extends through the passage and in a position blocking forward flow in the seats to the front contact ends. The connector is unitary with the bar and with the guide. This construction allows the system to be used with existing base parts.

The connector according to the invention is formed with a break line between itself and the bar and with another break line between itself and the guide so that the connector can be broken off the bar and guide.

The connector is outside the jacket. In addition the wires are arranged in a pair of parallel rows and the guide is formed as a double comb.

BRIEF DESCRIPTION OF THE DRAWING

The above and other objects, features, and advantages will become more readily apparent from the following description, reference being made to the accompanying drawing in which.

SPECIFIC DESCRIPTION

Figure 1B:
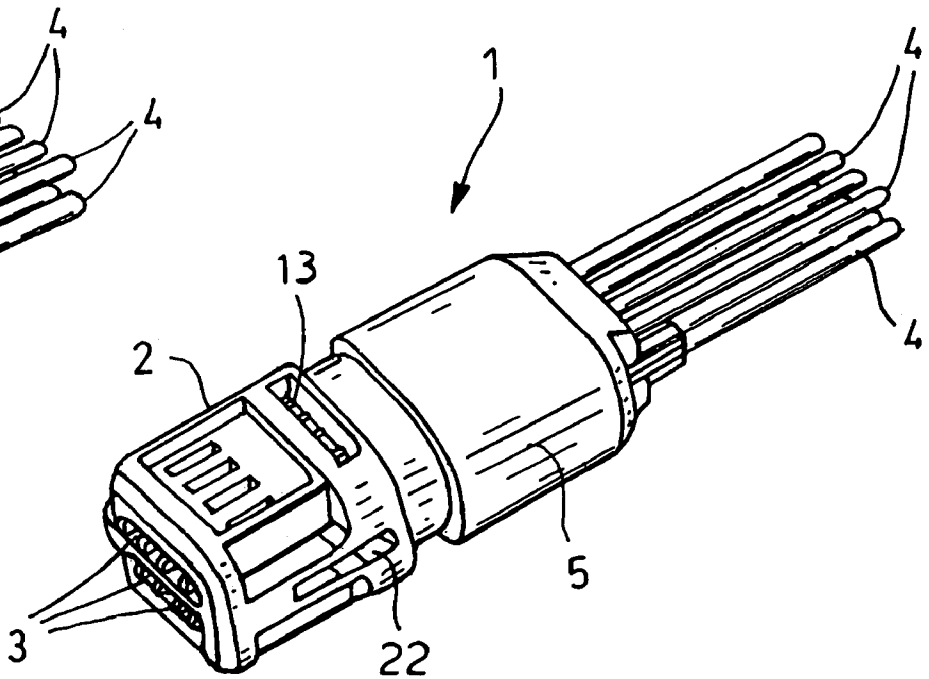
FIGS. 1A and 1B are front-end perspective views of the connector before and after molding of its jacket.

As seen in the drawing a connector 1 basically comprises a prefabricated hard-plastic base part 2 holding a plurality of contacts 3 connected to respective wires 4 and a soft-plastic or elastomeric jacket 5 that encapsulates the rear end of the base part 2, the front ends of the wires 4 where they enter the base part 2, and the rear ends of the contacts 3. The wires 4 can be separate or part of a ribbon cable.

Figure 1A:
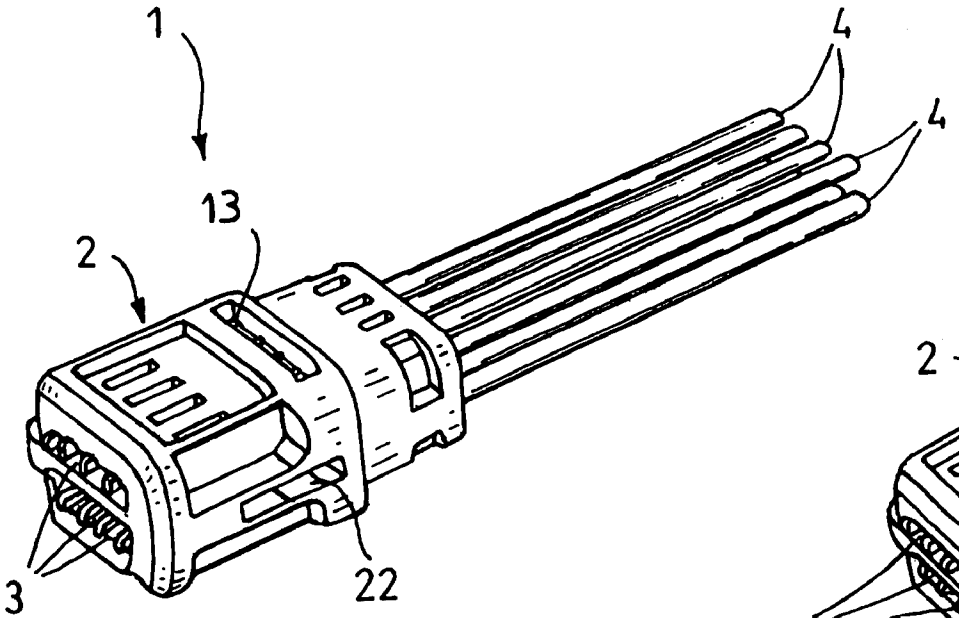
Figures 2A, 2B, 2C, 2D:
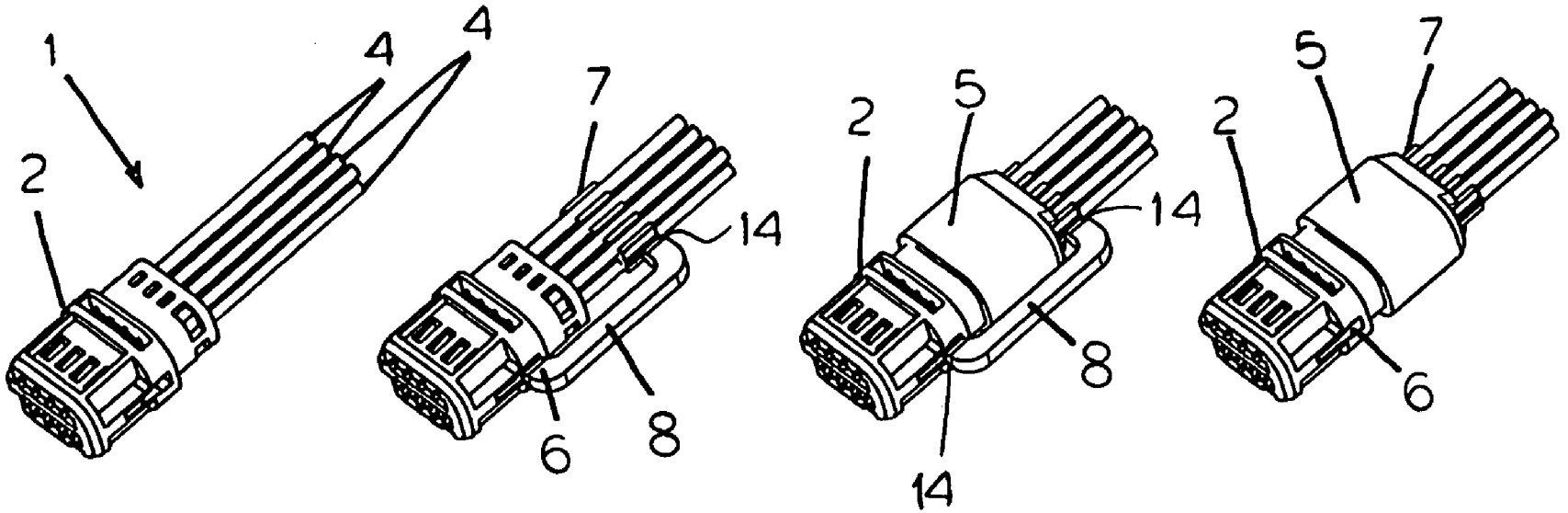
FIGS. 2A, 2B, 2C, and 2D are perspective views, with FIG. 2A generally corresponding to FIG. 1A and FIG. 2D generally corresponding to FIG. 1B, showing successive steps of making the connector according to the invention.
Figures 3A, 3B:
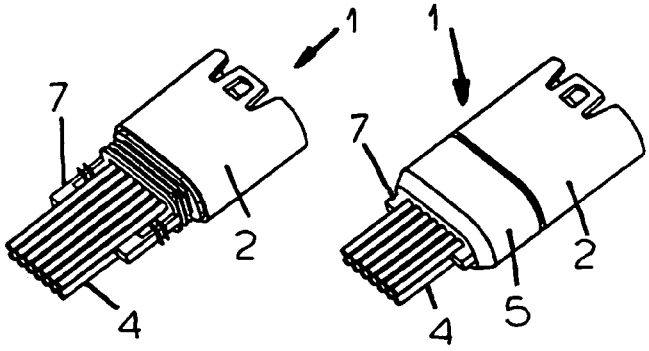
FIGS. 3A and 3B are rear-end perspective views of the connector before and after molding of its jacket.
Figure 5:
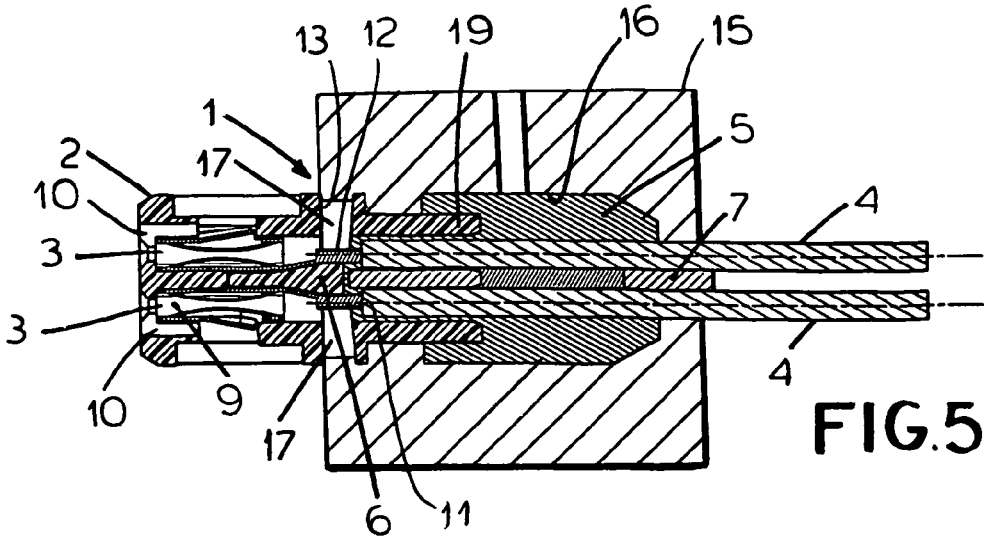
FIG. 5 is an axial or longitudinal section through the connector in a mold as it is being provided with its jacket.

More particularly the base part 2 as best seen in FIGS. 1A, 1B, and 5 is formed with two rows of seats 10, each row here having seven such seats 10. Each seat 10 in turn holds a standard metallic contact 3 having a front end 9 that can be formed as a pin or socket, here a socket, and a rear end 11 adapted to be secured to a conductor 12 of the respective wire 4, either by soldering or crimping, here by crimping.

The contacts 3 therefore are arrayed in an upper and lower level at a transverse spacing from each other.

In addition the base part 1 is formed with a pair of upwardly and lower transversely open slots 13 that open into the seats at the rear ends 12 of the contacts 3. Furthermore it is formed with a laterally throughgoing and longitudinally elongated slot or passage 22 between the rows of contacts 3 and slightly forward of their rear ends 9. The wires 4 fit loosely into rearwardly open holes 17 aligned with the seats 10. The passage 22 and slots 13 allow tools to be inserted into the part 1 to connect the wires 4 to the ends 12 of the contacts 3.

Figures 4A, 4B, 4C:
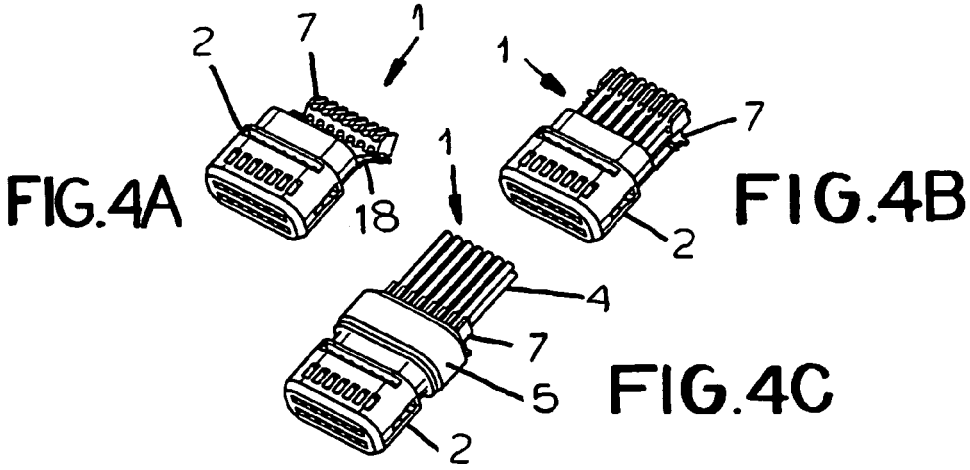
FIGS. 4A, 4B, and 4C are front-end perspective views of the connector during successive steps of manufacture and in particular illustrating how the wire guide works.

According to the invention as best seen in FIGS. 4A–4C there is also a guide 7 formed as an upwardly and downwardly open double comb adapted to fit with the rows of wires 4 rearward of the base part 1 and hold them in the desired spaced orientation. A flexible web 18 connects this guide 7 unitarily to the part 1.

This guide 7 can also be attached as shown in FIG. 2A-2D by a connector element 8 to a transverse and dielectric flow-blocking bar 6 that fits complementarily in and fills the passage 22. Front and rear score lines 14 connect the connector 6 to the comb 7 and bar 6 so that it can be removed as described below.

The connector 1 according to the invention is made in a two-part mold 15 having a cavity 16 and formed with downwardly and upwardly projecting front ridges 17 that fit in the slots 13 and bear on the upper and lower sides of forward portions of the rear ends 12 of the contacts 3.

Thus the body 5 is formed by injecting a hardenable synthetic resin int the cavity 16 so that it flows forward through the holes 17 around the wires 4 and fills the extreme rear ends of the seats 3 around the extreme rear-end portions of the contacts 3. This very solidly anchors the wires 4 in the base part 1.

Once the resin has cured, the connector 1 is demolded and the connector 8 can be broken off at the lines 14, leaving the blocking bar 6 and comb 7 imbedded in place.

We claim:

1. An electrical connector comprising:

a hard base part forming a plurality of rearwardly and forwardly open seat;

respective contacts in the seats each having a front end and a rear end;

respective wires projecting forwardly into the seats and connected in the seats to the rear contact ends;

a guide spaced rearward from the base part, engaged at least partially around the wires, and aligning the wires with the respective seats;

an element connecting the guide to the base part;

a soft jacket encapsulating a rear end of the base part, the guide, the element, and front ends of the wires and extending at least paratially into the rear seat ends.

2. The electrical connector defined in claim 1 wherein the element is flexible.

3. The electrical connector defined in claim 1 wherein the base part is formed with a transverse passage extending across the seats generally at the rear seat ends.

4. The electrical connector defined in claim 1 wherein the wires are arranged in a pair of parallel rows and the guide is formed as a double comb.

5. The electrical connector defined in claim 3, further comprising:

a flow-blocking bar extending through the passage and in a position blocking forward flow in the seats to the front contact ends.

6. The electrical connector defined in claim 5 wherein the connector is unitary with the bar and with the guide.

7. The electrical connector defined in claim 6 wherein the connector is formed with a break line between itself and the bar and with another break line between itself and the guide, whereby the connector can be broken off the bar and guide.

8. The electrical connector defined in claim 5 wherein the connector is outside the jacket.

* * * * *